US008141680B2

(12) United States Patent
Wigutoff

(10) Patent No.: US 8,141,680 B2
(45) Date of Patent: Mar. 27, 2012

(54) PORTABLE STEPPING SYSTEM

(76) Inventor: Norma Wigutoff, Seattle, WA (US)

( * ) Notice: Subject to any disclaimer, the term of this patent is extended or adjusted under 35 U.S.C. 154(b) by 110 days.

(21) Appl. No.: 12/757,751

(22) Filed: Apr. 9, 2010

(65) Prior Publication Data

US 2011/0247898 A1 Oct. 13, 2011

(51) Int. Cl.
*A47B 3/00* (2006.01)

(52) U.S. Cl. ..... 182/33; 182/223

(58) Field of Classification Search ..... 182/33, 182/35, 33.5, 33.6, 223; 482/52; D25/65; 108/99
See application file for complete search history.

(56) References Cited

U.S. PATENT DOCUMENTS 2,495,374 A * 1/1950 Horn ..... 4/476
5,357,876 A * 10/1994 Kniefel et al. ..... 108/92
5,474,509 A * 12/1995 Hodgdon ..... 482/52
5,735,586 A * 4/1998 Cheng ..... 312/235.1

* cited by examiner

*Primary Examiner* — Alvin Chin Shue
(74) *Attorney, Agent, or Firm* — Lowe Graham Jones PLLC

(57) ABSTRACT

A stepping platform includes an upper step platform and a lower step platform. The stepping platform may be manually moved from a stored position to a deployed, and vice-versa. The upper step platform includes a tread surface and side walls that cooperate to define a cavity into which the lower step platform fits when the stepping platform is in the stored position. The lower step platform also includes a tread surface and side walls. In one embodiment, a height of the lower step platform is about half of an overall height of the upper step platform. Further, both platforms may include tread surface areas sized to support both feet of a standing adult.

6 Claims, 3 Drawing Sheets

PORTABLE STEPPING SYSTEM

FIELD OF THE INVENTION

The present invention generally relates to a stepping system, and more specifically to a manually deployable and portable stepping system.

SUMMARY OF THE INVENTION

An embodiment of the present invention includes a stepping platform that is more stable and on which maneuvering is easier than conventional steps or stools. The stepping platform is manually collapsible and transportable, including an upper step platform and a lower step platform. The upper step platform defines a cavity sized to receive the lower step platform when the stepping platform is closed in a clamshell-fashion. Thus when folded or in a stored position, the lower step platform is completely tucked inside the upper step platform, and in one embodiment may be manually rotated out about a pivot joint or pin. In the presently preferred embodiment, each tread surface of each platform shall be large enough for a grown person, possibly with limited mobility, to comfortably turn around on or at least to place both feet on. The overall height of the lower step platform when in the deployed or unfolded position is about half that of the upper step platform.

In one aspect of the present invention, a stepping system includes a first step platform having a first step tread surface coupled to a riser and a plurality of side walls to define a first step platform cavity; a second step platform having a second step tread surface and a periphery sized to be receivable into the first step platform cavity, wherein a height of the second step platform is about half a height of the first step platform; and a connection mechanism coupled to the first step platform and configured to engage the second step platform, the connection mechanism arranged such that the second step platform is manually rotatable relative to the first step platform.

In another aspect of the present invention, a method of ingress or egress from a vehicle, the method including the steps of (1) arranging an upper step platform of a stepping system proximate a vehicle door; (2) manually moving a lower step platform relative to the upper step platform, each step platform sized to support both feet of a standing adult; (3) stepping onto one of either the upper or lower step platforms; and (4) stepping next onto the other one of the upper or lower step platforms, wherein a height of the lower step platform is about half a height of the upper step platform.

BRIEF DESCRIPTION OF THE DRAWINGS

Preferred and alternative embodiments of the present invention are described in detail below with reference to the following drawings.

DETAILED DESCRIPTION OF THE PREFERRED EMBODIMENTS

The present invention generally relates to, but is not limited to, a manually collapsible stepping platform that is more stable and on which maneuvering is easier than conventional steps or stools.

Figure 1:
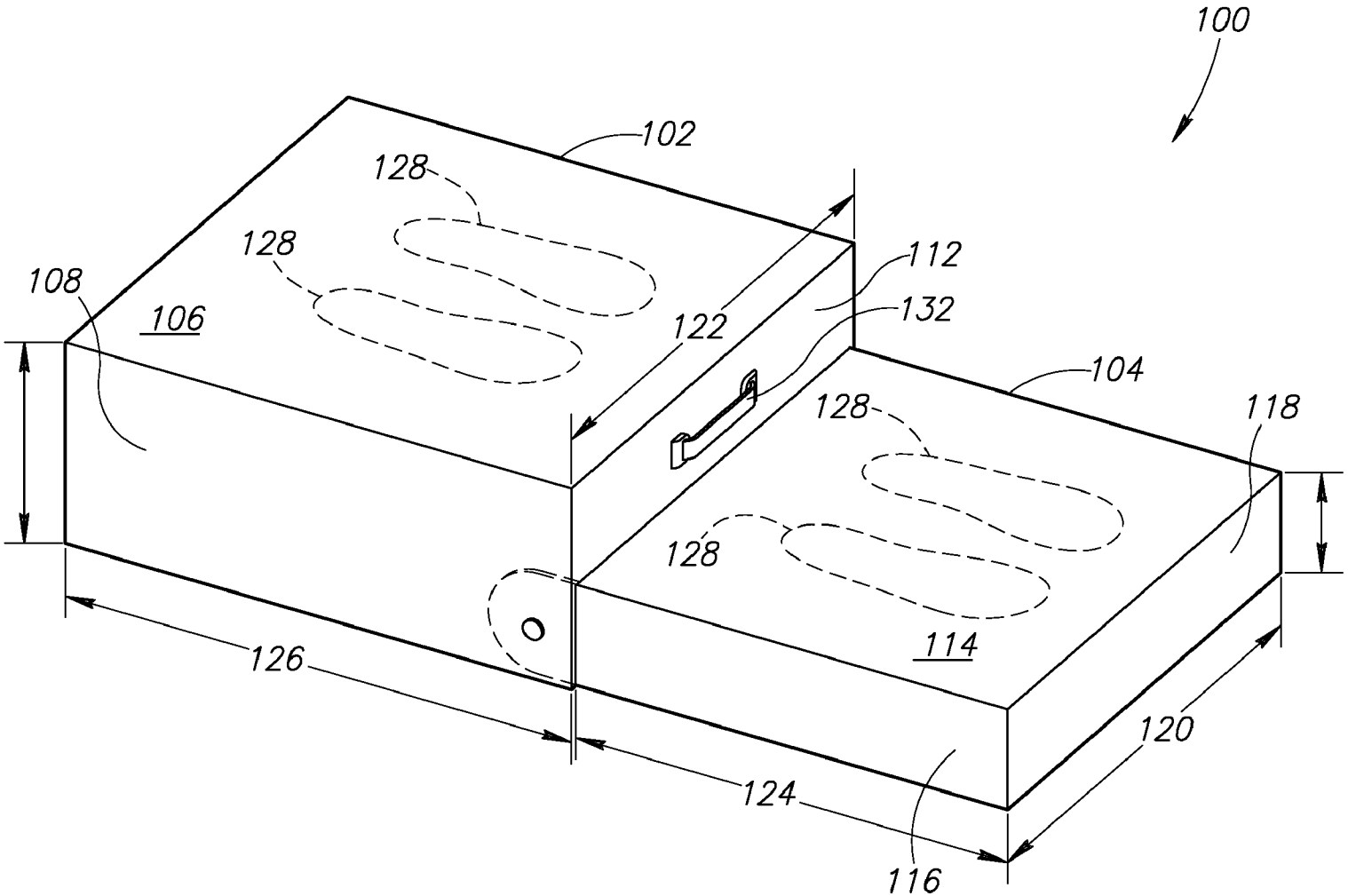
FIG. 1 is a perspective view of a stepping system in a deployed configuration according to an embodiment of the present invention.
Figure 3:
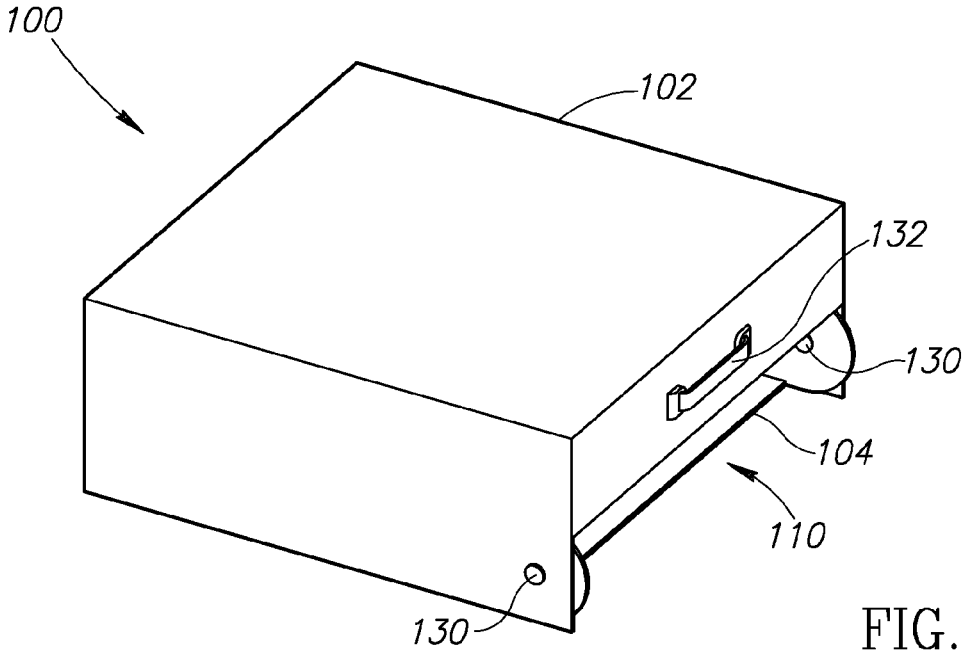
FIG. 3 is a perspective view of the stepping system of FIG. 1 in the stored configuration according to an embodiment of the present invention.

FIG. 1 shows a stepping platform 100 having an upper step platform 102 and a lower step platform 104. The stepping platform 100 is shown in a deployed position. The upper step platform 102 includes an upper step tread surface 106 and a plurality of upper step side walls 108 that cooperate to define a cavity 110 (FIG. 3). The front side wall 108 may take the form of a riser 112. The lower step platform 104 includes a lower step tread surface 114 and a plurality of lower step side walls 116. The front side wall 116 may take the form of a lower step riser 118. The lower step side walls 116 define a periphery sized to be received into the cavity 110 of the upper step platform 102 when the stepping platform 100 is in a folded position. More specifically, a width 120 of the lower step platform 104 is less than a width 122 of the upper step platform 102. And, a length 124 of the lower step platform 104 is less than a length 126 of the upper step platform 102. In one embodiment, a height 127 of the lower step platform 104 is about half of an overall height 129 of the upper step platform 102. Additionally or alternatively, the stepping platform 100 may have multiple levels and be configured for people who are unable or have difficulty climbing more than two to three inches per step. As such, the change of elevation from one step to the next may be no greater than three inches and preferably about two and a half inches. Further, the area of each platform is large enough to allow the person to stand thereon and make a complete, 360 degree, turn.

The tread surfaces 106, 114 may have a surface area that is sufficient to receive at least two footfalls 128, that is sufficient to allow a person standing thereon to maneuver both feet without being too close to the sidewalls 108, 116, or both. The tread surfaces 106, 114 may include a nonslip coating (not shown), have a roughened surface texture, or both. In addition, the stepping platform 100 may include a hard rubber or other rugged, nonslip material along a bottom edge to prevent or minimize movement of the stepping platform 100 relative to a ground surface (not shown). The first and second step platforms 102, 104 may take a variety of shapes, such as square, rectangular, curved or otherwise contoured (e.g., rounded corners).

Figure 2:
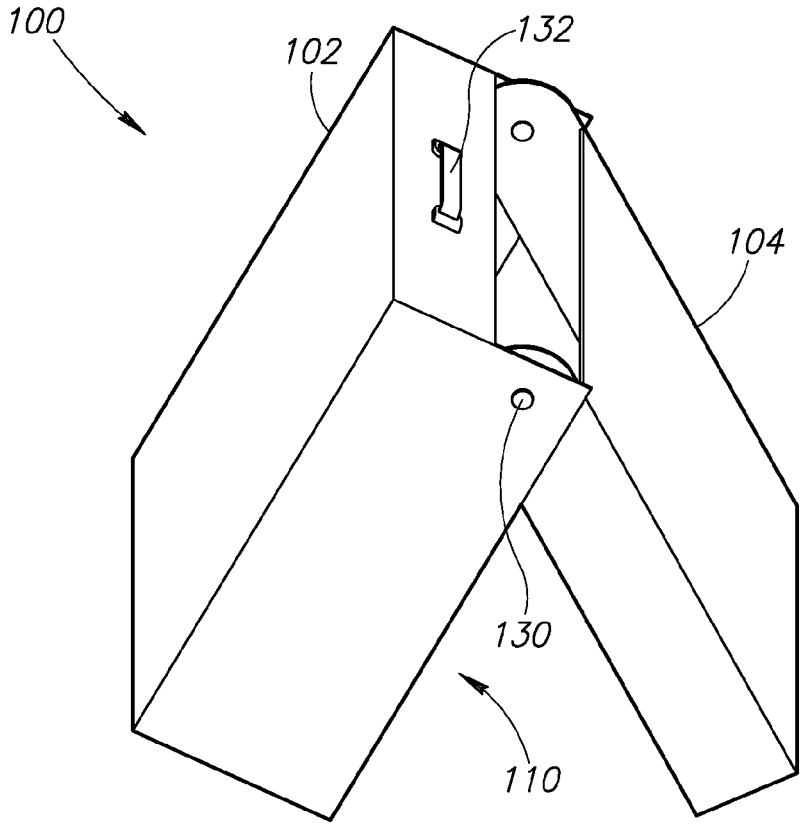
FIG. 2 is a perspective view of the stepping system of FIG. 1 being moved into a stored configuration according to an embodiment of the present invention.

FIG. 2 shows the stepping platform 100 in which the lower step platform 104 is pivotable into the cavity 110 of the upper step platform 102. A pivot mechanism 130 may take the form of a continuous pin or two separate pins having the same pivot axis. Further, a lockable hinge mechanism (not shown), such as a piano-type hinge, may be coupled to the upper and lower step platforms 102, 104. A handle 132 may be coupled to the stepping platform 100 to allow the stepping system 100 to be transported when in a folded or stored position. In the illustrated embodiment, the handle 132 is coupled to the riser 112 of the upper step platform 102. FIG. 3 shows the stepping platform 100 in the fully folded or stored configuration. In the illustrated embodiment, the lower step platform 104 may be folded or otherwise completely tucked inside the upper step platform 102.

Figure 4:
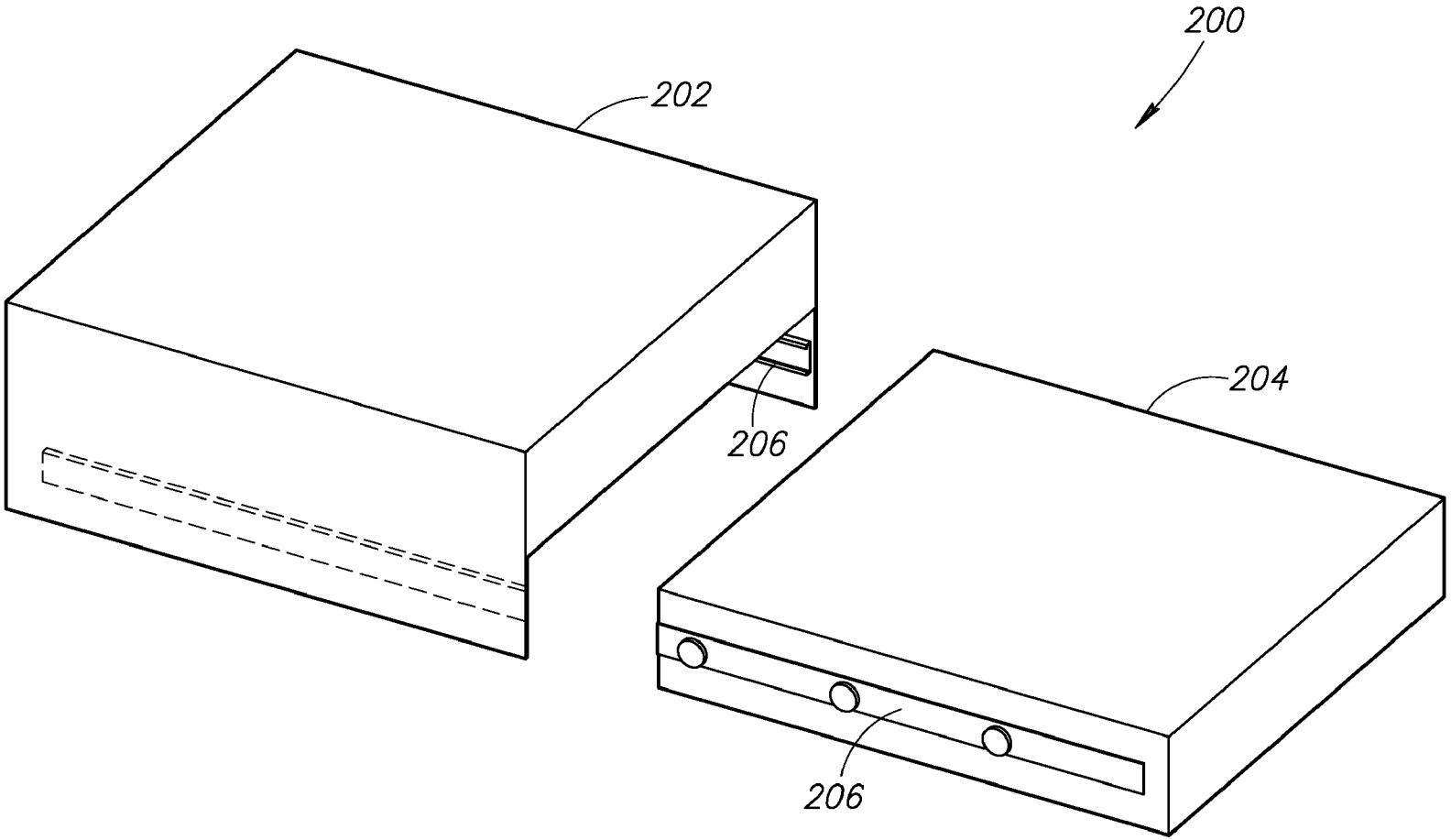
FIG. 4 is a perspective view of a first step platform with a track mechanism according to an embodiment of the present invention.

FIG. 4 shows a stepping system 200 having an upper step platform 202 slidably coupled to a lower step platform 204. In one embodiment, a track or guide 206, similar to a draw guide, may be used to telescopically move the lower step platform 204 relative to the upper step platform 202.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A stepping system comprising:

a upper step platform having an upper step tread surface extending from an upper front edge to an upper rear edge and bounded by upper first and second lateral edges coupled at the upper front edge to an upper riser and to an upper rear side wall at the upper rear edge parallel to and spaced apart from the upper riser, and having first and second upper lateral side walls connected to and extending from the first and second upper lateral edges and in opposed spaced apart relation, together to define an upper step platform cavity having an upper step height selected to be no greater than six inches;

a lower step platform having a lower step tread surface extending from a lower front edge to a lower rear edge and bounded by lower first and second lateral edges coupled at the lower front edge to a lower riser and to a lower rear side wall at the lower rear edge parallel to and spaced apart from the lower front riser at a lower step depth greater than twelve inches, and having first and second lower lateral side walls connected to and extending from the first and second lower lateral edges and in opposed spaced apart relationship at a lower step width greater than twelve inches, together to define a periphery sized to be receivable into the upper step platform cavity in a first position, wherein a lower step height is about half the upper step height; and a connection mechanism coupled to the upper step platform and configured to engage the lower step platform, the connection mechanism arranged such that the lower step platform is manually movable relative to the first step platform from the first position to a second position wherein the lower step platform extends from the upper riser to, in cooperation with the upper step platform to form a graduated platform, wherein the connection mechanism includes a pin having a rotational axis about which the second lower step platform rotates out of the first position into the second position.

2. The stepping system of claim 1, wherein the pin cooperates with a lock to form a lockable hinge mechanism.

3. The stepping system of claim 1, wherein the pin is a plurality of pins aligned along the rotational axis.

4. The stepping system of claim 1, further comprising a handle coupled to the upper riser to carry the system in the first position.

5. The stepping system of claim 1, wherein each of the upper and lower tread surfaces include at least one of a nonslip coating and a roughened surface texture.

6. The stepping system of claim 1, wherein upper and lower lateral side walls include at least one of a hard rubber and a nonslip material for engagement with a ground surface.

* * * * *